US010578111B2

(12) United States Patent
Xiao et al.

(10) Patent No.: US 10,578,111 B2
(45) Date of Patent: Mar. 3, 2020

(54) WELLBORE DEBRIS HANDLER FOR ELECTRIC SUBMERSIBLE PUMPS

(71) Applicant: Saudi Arabian Oil Company, Dhahran (SA)

(72) Inventors: Jinjiang Xiao, Dhahran (SA); Chidirim Enoch Ejim, Dammam (SA); Randall Alan Shepler, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/654,142

(22) Filed: Jul. 19, 2017

(65) Prior Publication Data

US 2018/0163729 A1 Jun. 14, 2018

Related U.S. Application Data

(60) Provisional application No. 62/432,953, filed on Dec. 12, 2016.

(51) Int. Cl.
*E21B 17/10* (2006.01)
*E21B 47/06* (2012.01)
(Continued)

(52) U.S. Cl.
CPC ..... *F04D 13/08* (2013.01); *E21B 17/10* (2013.01); *E21B 37/00* (2013.01); *E21B 43/128* (2013.01);
(Continued)

(58) Field of Classification Search
CPC ..... E21B 17/10; E21B 17/00; E21B 37/00; E21B 43/128; E21B 23/00; F04D 13/08; F04D 13/00; F04D 7/045; F04D 29/2288
(Continued)

(56) References Cited

U.S. PATENT DOCUMENTS 22,580 A * 1/1859 Proseus ..... B02C 2/005 241/293
69,174 A * 9/1867 Burns ..... B02C 2/005 241/293
(Continued)

OTHER PUBLICATIONS

International Search Report and Written Opinion for International Application No. PCT/US2017/065753; report dated Feb. 8, 2018; 11 pages.

*Primary Examiner* — Giovanna C Wright
*Assistant Examiner* — Yanick A Akaragwe
(74) *Attorney, Agent, or Firm* — Bracewell LLP; Constance G. Rhebergen; Linda L. Morgan

(57) ABSTRACT

Systems and methods for decreasing a size of debris entering an electrical submersible pump assembly in a subterranean well with a debris handling assembly include a handler housing with an inner bore and a housing cutting profile located on an inner surface of the inner bore. A cutting blade is secured to a rotating shaft within the inner bore of the handler housing, the cutting blade being aligned with a first portion of the housing cutting profile. A mill is secured to the rotating shaft, the mill aligned with a second portion of the housing cutting profile. An annular mill space is defined by an outer surface of the mill and the inner surface of the inner bore, the annular mill space decreasing in a radial dimension in a downstream direction.

19 Claims, 4 Drawing Sheets

(51) Int. Cl.

| | |
|---|---|
| ***F04D 13/08*** | (2006.01) |
| ***F04B 47/06*** | (2006.01) |
| ***F04B 17/03*** | (2006.01) |
| ***E21B 43/12*** | (2006.01) |
| ***F04D 29/70*** | (2006.01) |
| ***E21B 37/00*** | (2006.01) |
| *E21B 17/00* | (2006.01) |
| *E21B 23/00* | (2006.01) |
| *F04B 47/00* | (2006.01) |
| *F04D 13/00* | (2006.01) |

(52) U.S. Cl.
CPC ..... *F04B 17/03* (2013.01); *F04B 47/06* (2013.01); *F04D 13/086* (2013.01); *F04D 29/708* (2013.01); *E21B 17/00* (2013.01); *E21B 23/00* (2013.01); *F04B 47/00* (2013.01); *F04D 13/00* (2013.01)

(58) Field of Classification Search
USPC ..... 241/293
See application file for complete search history.

(56) References Cited

U.S. PATENT DOCUMENTS

| | | | | |
|---|---|---|---|---|
| 4,430,214 | A | 2/1984 | Baker | |
| 6,361,272 | B1 | 3/2002 | Bassett | |
| 7,343,967 | B1 | 3/2008 | Floyd | |
| 7,841,826 | B1 | 11/2010 | Phillips | |
| 8,562,287 | B2 | 10/2013 | Schmidt et al. | |
| 2007/0023188 | A1* | 2/2007 | Roberts | E21B 10/43 166/298 |
| 2008/0066920 | A1 | 3/2008 | Allcorn et al. | |
| 2015/0233228 | A1 | 8/2015 | Roth et al. | |

* cited by examiner

WELLBORE DEBRIS HANDLER FOR ELECTRIC SUBMERSIBLE PUMPS

CROSS REFERENCE TO RELATED APPLICATION

This application claims priority to and the benefit of U.S. Provisional Application Ser. No. 62/432,953, filed Dec. 12, 2016, titled "Wellbore Debris Handler for Electric Submersible Pumps," the full disclosure of which is incorporated herein by reference in its entirety for all purposes.

BACKGROUND OF THE DISCLOSURE

1. Field of the Disclosure

The disclosure relates generally to electrical submersible pumps and in particular, to debris handling for electrical submersible pump assemblies.

2. Description of the Related Art

One method of producing hydrocarbon fluid from a well bore that lacks sufficient internal pressure for natural production is to utilize an artificial lift method such as an electrical submersible pump (ESP). A string of tubing or pipe known as a production string suspends the submersible pumping device near the bottom of the well bore proximate to the producing formation. The submersible pumping device is operable to retrieve production zone fluid, impart a higher pressure into the fluid and discharge the pressurized production zone fluid into production tubing. Pressurized well bore fluid rises towards the surface motivated by difference in pressure.

During production operation, debris and foreign matter larger than the ESP intake screen ports tend to cause severe erosive wear on upstream components such as motor and protector, and plugging of the intake screen ports. The erosion results in weakened housing strength and increases the risk of system failure.

The cumulative effect of the blocked ports is that the flow into the pump decreases and therefore production to the surface reduces. As more debris continues to cover the intake screen, a point is reached when the entry ports are blocked such that no flow goes into the ESP. At this instant, the intake screen walls are subjected to a crushing pressure equal to the corresponding static pressure at the intake setting depth. Given time, this high pressure causes the screen to collapse or cave-in. The screen-collapse further accelerates migration of even larger sized foreign materials into the pump impeller resulting in complete blockage of the impeller inlet and running clearances.

The consequences of the above issues can be catastrophic depending on the stage of screen blockage. For instance, in the early stage of screen clogging when production flow is reducing, it could be such that the flow rate falls below the minimum required to cool the motor. As a result, the motor temperature rises with this decreasing flow rate to a point when the motor will experience burnt-out and ESP failure. On the other hand, if the screen has collapsed before motor failure, pump impeller inlet and running clearances are blocked, pump heat generation increases and high motor load occurs, which also results in motor burn-out. In either case, these failures result in deferred production and need to have a rig to work-over the well, which eventually leads to higher field asset operating costs.

SUMMARY OF THE DISCLOSURE

Embodiments disclosed herein provide an electrical submersible pump assembly that includes a debris handler installed upstream of the ESP to substantially reduce the debris size so that the debris can mix with the produced fluid and pass through the pump thereby enhancing ESP reliability and runlife and lowering field operating costs. Systems and methods described herein minimize or prevent pump clogging, thereby increasing pump life, which can be particularly useful in upstream oilfield, midstream oil sands, heavy oil, or tar sands operations.

In an embodiment of this disclosure, a debris handling assembly for decreasing a size of debris entering an electrical submersible pump assembly in a subterranean well includes a handler housing, the handler housing being a generally tubular member with an inner bore. A housing cutting profile is located on an inner surface of the inner bore of the handler housing. A cutting blade is secured to a rotating shaft within the inner bore of the handler housing, the cutting blade being aligned with a first portion of the housing cutting profile. A mill is secured to the rotating shaft within the inner bore of the handler housing, the mill aligned with a second portion of the housing cutting profile. An annular mill space is defined by an outer surface of the mill and the inner surface of the inner bore, the annular mill space decreasing in a radial dimension in a downstream direction.

In alternate embodiments the mill can have a series of mill cutter profiles located on the outer surface of the mill. The series of mill cutter profiles can include longer teeth with a longer radial dimension at an upstream region of the outer surface and shorter teeth with a shorter radial dimension at a downstream region of the outer surface. The series of mill cutter profiles can be formed of a hard material selected from a group consisting of polycrystalline diamond compact, silicon carbide, tungsten carbide, and boron nitride. The mill can have a mill grinding profile located on the outer surface of the mill downstream of the series of mill cutter profiles.

In other alternate embodiments, the outer surface of the mill can have a frustoconical shape. The cutting blade and the mill can be spaced axially apart along the rotating shaft. The handler housing can include intake holes, the intake holes being free of a screen member. A handler housing outlet can be axially spaced apart from a downstream end of the mill.

In an alternate embodiment of the disclosure, an electrical submersible pump assembly for producing hydrocarbons from a subterranean well includes a motor, a pump, and a seal section located between the motor and the pump. A debris handling assembly is located upstream of the pump, the debris handling assembly including a handler housing, the handler housing being a generally tubular member with an inner bore. The debris handling assembly also includes a housing cutting profile located on an inner surface of the inner bore of the handler housing and a cutting blade secured to a rotating shaft within the inner bore of the handler housing, the cutting blade being aligned with a first portion of the housing cutting profile. The debris handling assembly further includes a mill secured to the rotating shaft within the inner bore of the handler housing, the mill aligned with a second portion of the housing cutting profile. The debris handling assembly also includes an annular mill space, the annular mill space defined by an outer surface of the mill and the inner surface of the inner bore, the annular mill space decreasing in a radial dimension in a downstream direction.

In alternate embodiments, the debris handling assembly can be located upstream of the motor. A lower packer can be positioned to prevent wellbore fluids from traveling downstream past the electrical submersible pump assembly external of the debris handling assembly. The handler housing can be rotationally static within the subterranean well. The outer surface of the mill can have a frustoconical shape.

In another alternate embodiment of this disclosure, a method for decreasing a size of debris entering an electrical submersible pump assembly in a subterranean well with a debris handling assembly includes providing a handler housing, the handler housing being a generally tubular member with an inner bore and having a housing cutting profile located on an inner surface of the inner bore of the handler housing. A shaft within the inner bore of the handler housing is rotated to rotate a cutting blade secured to a rotating shaft, and to rotate a mill secured to the rotating shaft. The cutting blade is aligned with a first portion of the housing cutting profile and the mill is aligned with a second portion of the housing cutting profile. An annular mill space is defined by an outer surface of the mill and the inner surface of the inner bore, the annular mill space decreasing in a radial dimension in a downstream direction.

In other alternate embodiments, the mill can have a series of mill cutter profiles located on the outer surface of the mill that includes longer teeth with a longer radial dimension at an upstream region of the outer surface and further includes shorter teeth with a shorter radial dimension at a downstream region of the outer surface, the method further comprising progressively decreasing a size of the debris with the housing cutting profile and the series of mill cutter profiles as the debris moves axially along the mill.

In alternate embodiments, the method can include grinding the debris with a mill grinding profile of the mill, the mill grinding profile being located downstream of mill cutter profiles. The debris can be moved radially outward with rotational movement of the cutting blade and the mill so that the debris contacts the housing cutting profile. An output stream of the debris handling assembly can be directed towards a pump of the electrical submersible pump assembly. An input stream can be directed into the debris handling assembly upstream of a pump and motor of the electrical submersible pump assembly.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
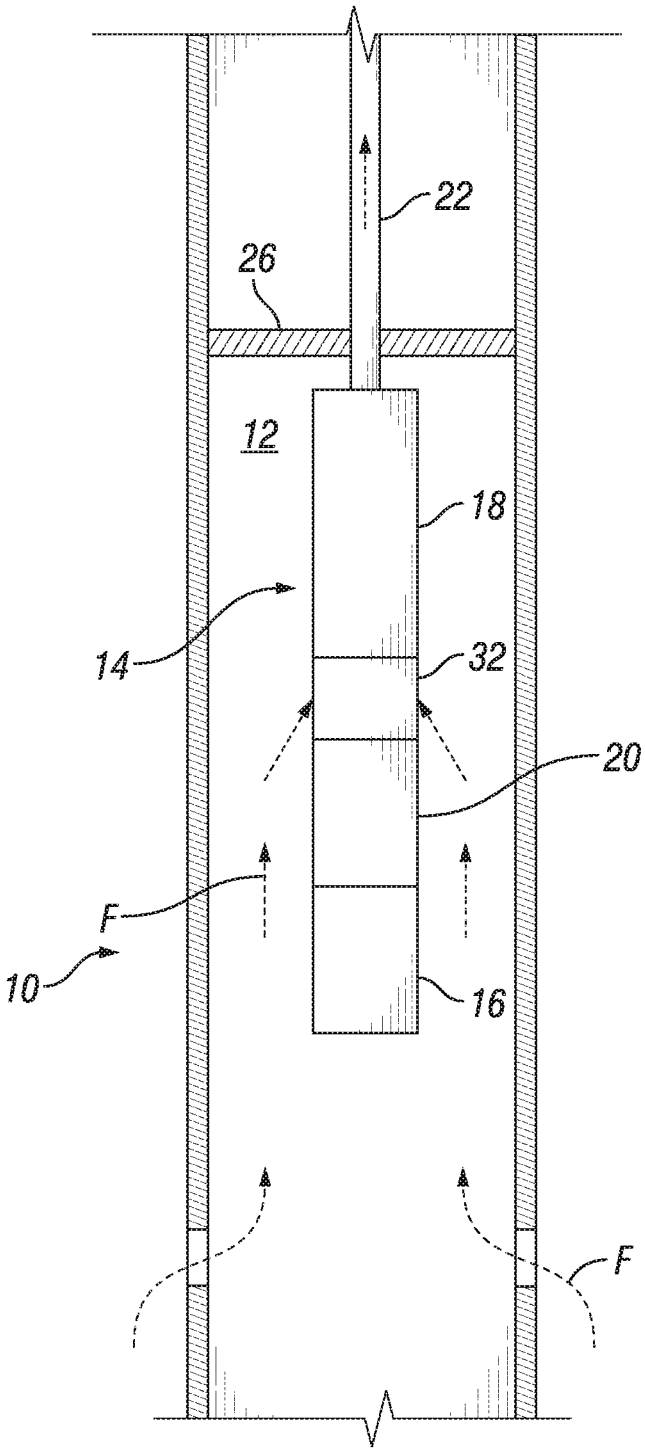
FIG. 1 is a schematic section view of a subterranean well having an electrical submersible pump assembly, in accordance with an embodiment of this disclosure.

Looking at FIG. 1, subterranean well 10 includes wellbore 12. Electrical submersible pump assembly 14 is located within wellbore 12. Electrical submersible pump assembly 14 of FIG. 1 includes motor 16 which is used to drive a pump 18 of electrical submersible pump assembly 14. Certain elements of motor 16 are enclosed within a motor housing that is a generally cylindrically shaped member with a sidewall defining an inner cavity that houses elements of motor 16.

Figure 2:
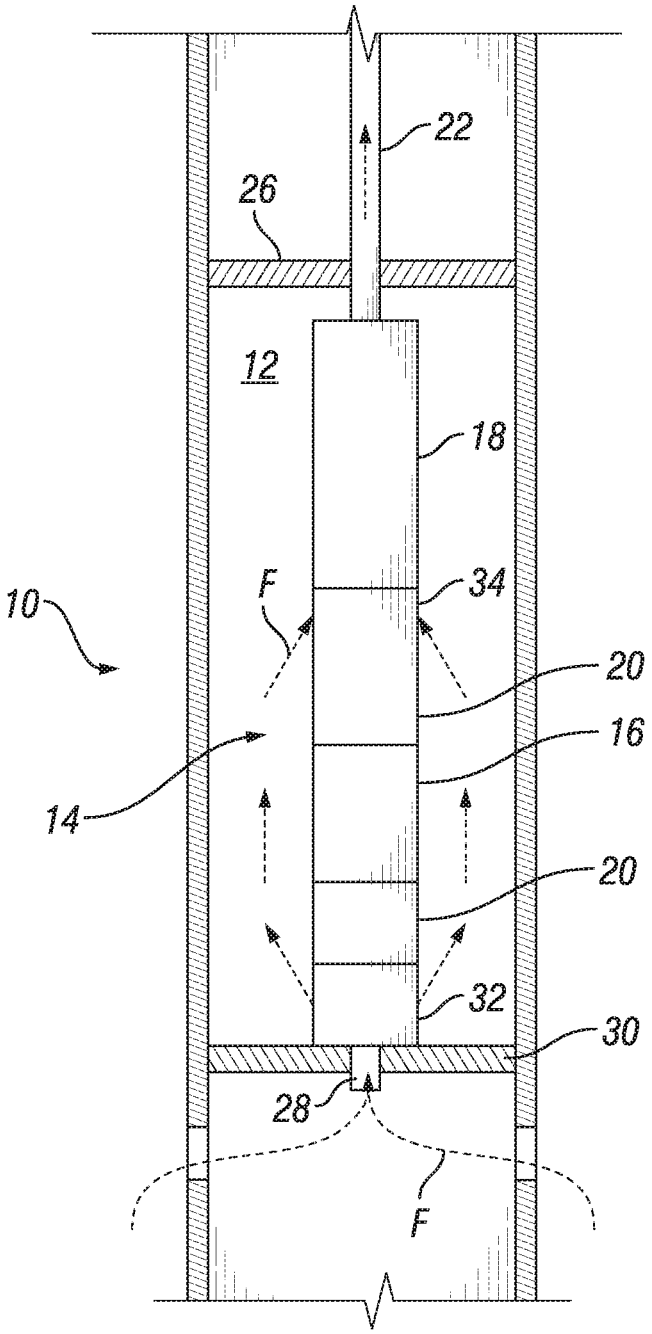
FIG. 2 is a schematic section view of a subterranean well having an electrical submersible pump assembly, in accordance with an embodiment of this disclosure.
Figure 3:
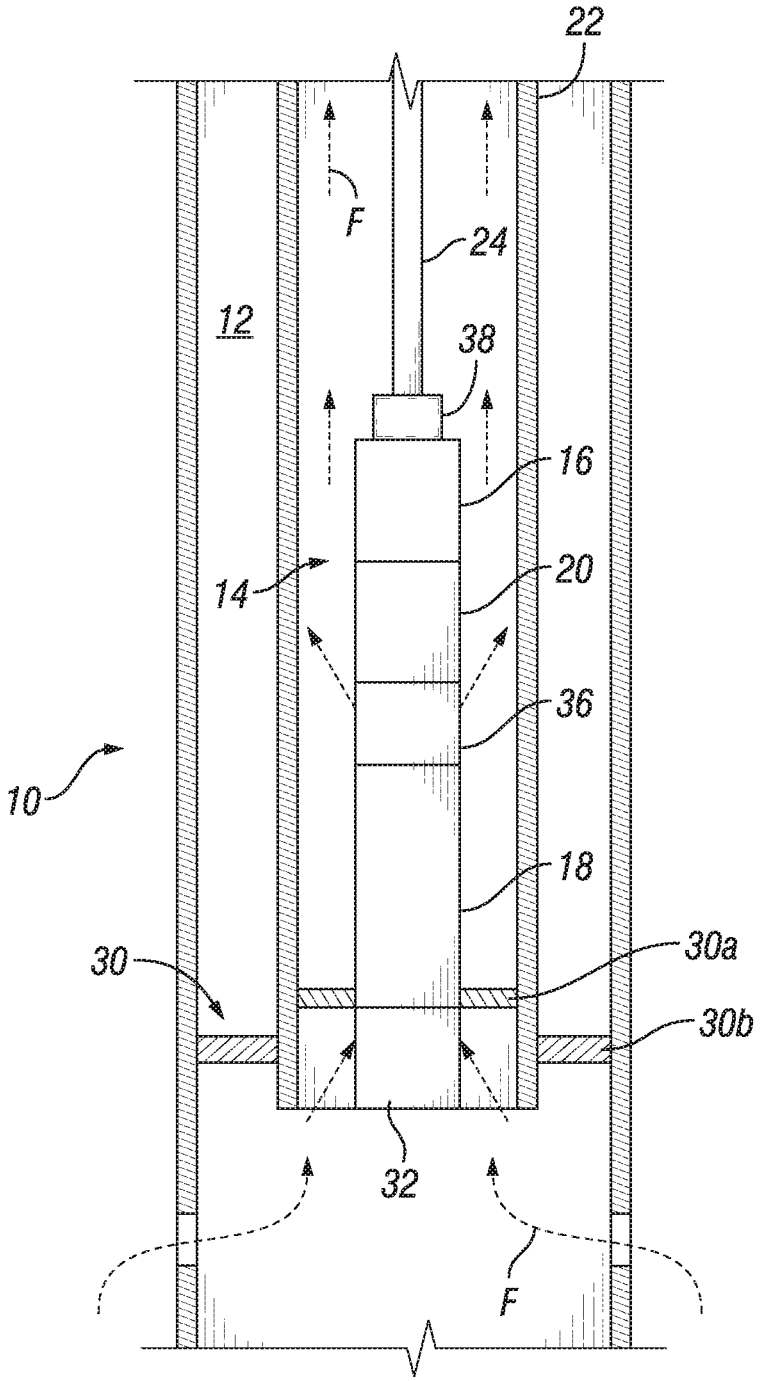
FIG. 3 is a schematic section view of a subterranean well having an electrical submersible pump assembly, in accordance with an embodiment of this disclosure.

Subterranean well 10 is shown as a generally vertical well in the example embodiments of FIGS. 1-3. Therefore, when used herein, the term upstream would be used to define a position that is axially lower in the subterranean well than a position that is described as being downstream. In alternate embodiments where subterranean well 10 is not vertical, such as an inclined or horizontal well, the term upstream would be used to define a position that is farther from the earth's surface, as measured along the fluid flow of the well fluids, within in the subterranean well than a position that is described as being downstream, regardless of the relative axial location of such positions.

Pump 18 can be, for example, a centrifugal pump. Certain elements of pump 18 are enclosed within a pump housing that is a generally cylindrically shaped member with a sidewall defining an inner cavity that houses elements of pump 18. Pump 18 can consist of stages, which are made up of impellers and diffusers. The impeller, which is rotating, adds energy to the fluid to provide head, whereas the diffuser, which is stationary, converts the kinetic energy of fluid from the impeller into head. The pump stages are typically stacked in series to form a multi-stage system that is contained within the pump housing. The sum of head generated by each individual stage is summative; hence, the total head developed by the multi-stage system increases linearly from the first to the last stage.

Between motor 16 and pump 18 is a protector 20. Protector 20 can be used for equalizing pressure within electrical submersible pump assembly 14 with that of wellbore 12. Protector 20 can also absorb the thrust load from pump 18, transmit power from motor 16 to pump 18, provide and receive additional motor oil as the temperature changes, and prevent well-fluid from entering motor 16. Depending on the location of protector 20, protector 20 can also take up any thrust and shaft load coming from debris handling assembly 32 and prevent such loads from being passed to motor 16. Certain elements of protector 20 are enclosed within a seal section housing that is a generally cylindrically shaped member with a sidewall defining an inner cavity that houses elements of protector 20.

In the example embodiment of FIGS. 1-2, electrical submersible pump assembly 14 is suspended within wellbore 12 with tubing 22. Tubing 22 is an elongated tubular member that extends within subterranean well 10. Tubing 22 can be, for example, production tubing formed of carbon steel material, carbon fiber tube, or other types of corrosion resistance alloys or coatings. In the example embodiment of FIG. 3, electrical submersible pump assembly 14 is suspended within tubing 22 with power cable 24.

Looking at FIG. 2, Upper packer 26 can be located downstream of electrical submersible pump assembly 14 and can form a seal between an outer diameter of tubing 22 and a surface of wellbore 12. Upper packer 26 can isolate a portion of subterranean well 10 from adjacent portions of subterranean well 10.

Looking at FIG. 1, motor 16 is the member that is located at the upstream end of electrical submersible pump assembly 14. Protector 20 is located adjacent to motor 16 on a downstream side of motor 16. Pump 18 is upstream of protector 20 and a discharge of pump 18 is in fluid communication with tubing 22. In the example embodiment of FIG. 1, debris handling assembly 32 is located between pump 18 and protector 20. In the embodiment of FIG. 1, debris handling assembly 32 has a radially oriented intake and an axially oriented discharge. In alternate embodiments, debris handling assembly 32 can have an axially oriented intake and a radially oriented discharge (FIG. 2), or debris handling assembly 32 can have an axially oriented intake and an axially oriented discharge (not shown), or debris handling assembly 32 can have a radially oriented intake and a radially oriented discharge (not shown).

Looking at the alternate embodiment of FIG. 2, stinger 28 is located at an upstream end of electrical submersible pump assembly 14. Stinger 28 can have different diameters depending on the flow requirement of a particular development. Stinger 28 is circumscribed by lower packer assembly 30. In the example of FIG. 2, lower packer assembly 30 engages an outer diameter of stinger 28 and a surface of wellbore 12. Lower packer assembly 30 prevents the flow of wellbore fluids, and any debris contained within the wellbore fluids, from traveling downstream past the electrical submersible pump assembly 14 without first passing through debris handling assembly 32. The flow of wellbore fluids, together with any debris contained within the wellbore fluids are jointly labeled F in the figures. Fluid F enters wellbore 12 from a formation adjacent wellbore 12. Fluid F is pressurized within pump 18 and travels up to a wellhead assembly at the earth's surface through tubing 22.

A first protector 20 is located adjacent to, and upstream of, debris handling assembly 32. In the embodiment of FIG. 2, debris handling assembly 32 has an axially oriented intake and a radially oriented discharge. Motor 16 and a second protector 20 are located sequential adjacent to the first protector 20. Intake 34 is located adjacent to, and upstream of, second protector 20 and intake 34 is in fluid communication with pump 18.

Looking at the alternate embodiment of FIG. 3, debris handling assembly 32 is located at an upstream end of electrical submersible pump assembly 14. In the embodiment of FIG. 3, debris handling assembly 32 has a radially oriented intake and an axially oriented discharge. Lower packer assembly 30 includes inner lower packer **30*a* and outer lower packer 30*b*. Inner lower packer 30*a* circumscribes a region of electrical submersible pump assembly 14 that is adjacent to debris handling assembly 32. In the example of FIG. 3, inner lower packer 30*a* is shown circumscribing pump 18. In alternate embodiments, lower packer 30*a* could circumscribe another element of electrical submersible pump assembly 14 that is downstream of discharge 36. Inner lower packer 30*a* seals the annulus between electrical submersible pump assembly 14 and tubing 22. Outer lower packer 30*b* seals the annulus between tubing 22 and the surface of wellbore 12. Lower packer assembly 30 prevents the flow of wellbore fluids, and any debris contained within the wellbore fluids, from traveling downstream past the electrical submersible pump assembly 14 without first passing through debris handling assembly 32**.

Pump 18 is adjacent to, and downstream of, debris handling assembly 32. After passing through pump 18, fluid F is discharged out of discharge 36 and into the annulus between electrical submersible pump assembly 14 and tubing 22. Protector 20 and motor 16 are located consecutively adjacent to, and downstream of, discharge 36. Cable adapter 38 secures power cable 24 to motor 16 and allows power cable 24 to supply electrical power to motor 16.

Figure 4:
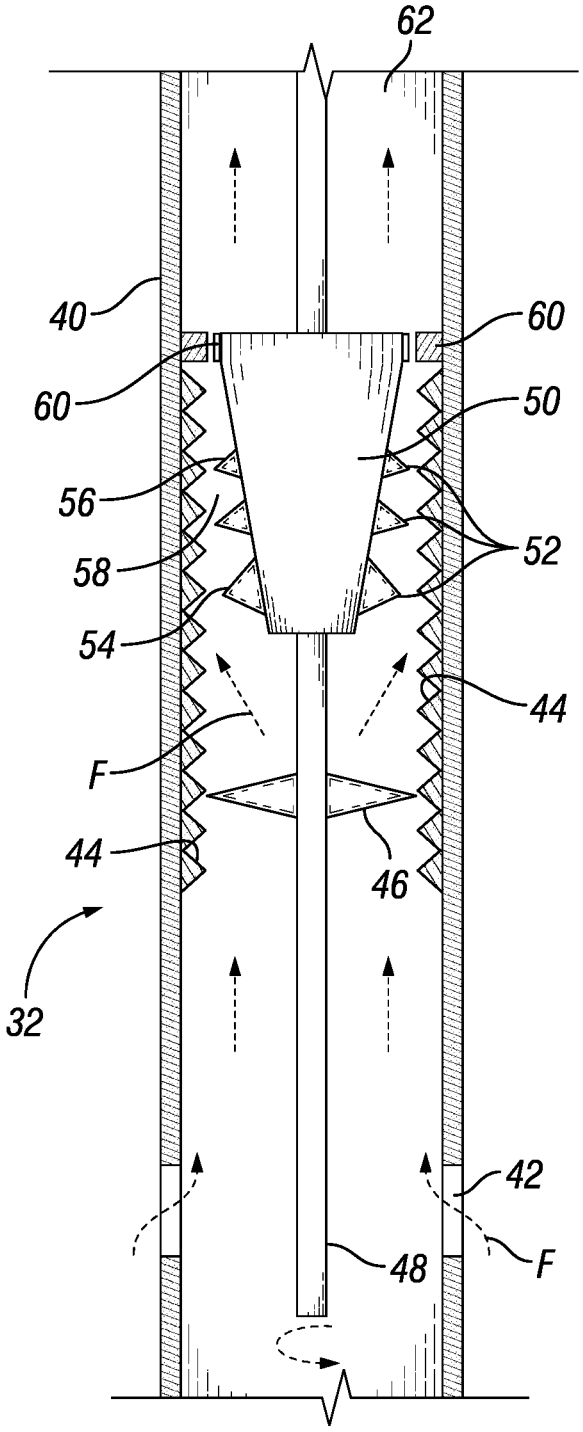
FIG. 4 is a schematic section view of a debris handler of an electrical submersible pump assembly, in accordance with an embodiment of this disclosure.

Looking at FIG. 4, debris handling assembly 32 is shown in further detail. Debris handling assembly 32 can be of a bolt-on type or it can be integrally formed with other elements of electrical submersible pump assembly 14. Debris handling assembly 32 can include handler housing 40. Handler housing 40 can be a generally tubular member with an inner bore. Intake holes 42 extend through a sidewall of handler housing 40 so that fluid F can pass into the inner bore of handler housing 40. Intake holes 42 are free of a screen member so that debris can easily pass into the inner bore of handler housing 40, even the larger components of the debris, without blocking intake holes 42.

Housing cutting profile 44 is located on an inner surface of the inner bore of handler housing 40. Housing cutting profile 44 can include a series of blades or teeth shapes protrusions that extend radially inward from the inner surface of the inner bore of handler housing 40. Housing cutting profile 44 can have a variety of sizes, shapes and patterns so long as housing cutting profile 44 provides sufficient cutting efficiency. As an example, housing cutting profile 44 can have more pointed teeth for a better cutting capacity compared to those with less pointed teeth; but the base of the teeth profile will be wide enough to withstand the loads on cutting profile 44.

Housing cutting profile 44 can be formed of a material that is hardened to be strong and tough enough to withstand abrasion, erosion and hydraulic loading from the debris and other foreign materials that are being broken down to much smaller pieces. Housing cutting profile 44 can be formed of a material that is therefore highly abrasive-resistant and corrosion resistance material such as, for example, polycrystalline diamond compact, silicon carbide, tungsten carbide, or boron nitride.

Debris handling assembly 32 also includes cutting blade 46. Cutting blade 46 is secured to rotating shaft 48 within the inner bore of handler housing 40. Rotating shaft 48 can be rotated by motor 16. Rotating shaft 48 can rotate at the same rate of rotation as motor 16. In alternate embodiments, a manual gearbox with a clutch mechanism or an automatic and flexdrive system can be incorporated so that rotating shaft 48 can rotate at a different rate of rotation as motor 16. In such an embodiment, the flow of fluids around a gearbox will be sufficient to dissipate this heat and keep the gearbox mechanism adequately cool for effective operation.

Cutting blade 46 is axially aligned with a first portion of housing cutting profile 44. Cutting blade 46 has a maximum outer diameter that is smaller than a diameter of the inner surface of the inner bore of handler housing 40. As cutting blade 46 rotates, cutting blade 46 applies a shearing and cutting effect to slice debris into smaller pieces. At the same time, cutting blade 46 imparts a swirling motion to the cut pieces of debris, which move radially outwards towards the sharp edges of housing cutting profile 44, where the debris size is reduced further by a shearing and tearing action. Cutting blade 46 can have a variety of sizes, shapes and patterns so long as cutting blade 46 provides sufficient cutting efficiency in combination with cutting profile 44, and can withstand the loads on cutting blade 46.

Cutting blade 46 can be formed of a material that is hardened to be strong and tough enough to withstand abrasion, erosion and hydraulic loading from the debris and other foreign materials that are being broken down to much smaller pieces. Cutting blade 46 can be formed of a material that is therefore highly abrasive-resistant and corrosion resistance material such as, for example, polycrystalline diamond compact, silicon carbide, tungsten carbide, or boron nitride.

Debris handling assembly 32 further includes mill 50. Mill 50 is secured to rotating shaft 48 within the inner bore of handler housing 40. Cutting blade 46 and mill 50 are spaced axially apart along rotating shaft 48. Mill 50 is aligned with a second portion of the housing cutting profile 44. Mill 50 can have a series of mill cutter profiles 52 located on the outer surface of mill 50. The series of mill cutter profiles 52 can have longer teeth 54 with a longer radial dimension at an upstream region of the outer surface and shorter teeth 56 with a shorter radial dimension at a downstream region of the outer surface. Mill cutter profiles 52 can have a variety of sizes, shapes and patterns so long as mill cutter profiles 52 provide sufficient cutting efficiency. As an example, mill cutter profiles 52 can have more pointed teeth for a better cutting capacity compared to those with less pointed teeth; but the base of the teeth profile must be wide enough to withstand the loads on mill cutter profiles 52.

The series of mill cutter profiles 52 can be formed of a material that is hardened to be strong and tough enough to withstand abrasion, erosion and hydraulic loading from the debris and other foreign materials that are being broken down to much smaller pieces. The series of mill cutter profiles 52 can be formed of a material that is therefore highly abrasive-resistant and corrosion resistance material such as, for example, polycrystalline diamond compact, silicon carbide, tungsten carbide, or boron nitride.

Annular mill space 58 is defined by an outer surface of mill 50 and the inner surface of the inner bore of handler housing 40. Annular mill space 58 decreases in a radial dimension in a downstream direction thereby forming a funnel-like cavity to accommodate large pieces of debris without causing clogging. When the debris moves into regions of smaller area in the funnel-like annular mill space 58, the debris experiences additional cutting, shearing and tearing, which reduces the size of the debris even further. In order to define the shape of annular mill space 58, the outer surface of mill 50 can have a frustoconical shape. In alternate embodiments, the outer surface of mill 50 can have a cylindrical shape and the inner surface of the inner bore of handler housing 40 can instead have a frustoconical shape.

Mill 50 can also have mill grinding profile 60. Mill grinding profile 60 is located on the outer surface of mill 50 and on an inner surface of the inner bore of handler housing 40 downstream of the series of mill cutter profiles 52. Both mill cutter profiles 52 and mill grinding profile 60 can be integral elements of a solid member that is mounted on, or a part of, rotating shaft 48. Mill grinding profile 60 can be made up of parallel and roughened hard surfaces that are close enough to each other to pulverize any debris that passes between the surfaces of mill grinding profile 60.

Mill grinding profile 60 can be formed of a material that is hardened to be strong and tough enough to withstand abrasion, erosion and hydraulic loading from the debris and other foreign materials that are being broken down to much smaller pieces. Mill grinding profile 60 can be formed of a material that is therefore highly abrasive-resistant and corrosion resistance material such as, for example, polycrystalline diamond compact, silicon carbide, tungsten carbide, or boron nitride After passing through mill grinding profile 60, fluid F with the minimally sized debris, passes through handler housing outlet 62. Handler housing outlet 62 is axially spaced apart from a downstream end of mill 50 so that fluid F is no longer rotating while exiting handler housing 40. Debris handling assembly 32 can have a radially or axially oriented intake and a radially or axially oriented discharge. In the embodiment of FIG. 4, debris handling assembly 32 has a radially oriented intake and an axially oriented discharge. Although FIG. 4 is shown as a single stage type system, two or more debris handling assemblies 32 can be utilized in a single electrical submersible pump assembly 14 to form a multi-stage type debris handling system. Although described herein for use with an ESP system, debris handling assembly 32 can also be used with alternate systems, such as gas handlers.

In an example of operation, fluid F that includes large debris material enters the debris handling assembly 32 through the large intake holes 42. As the debris comes into contact with cutting blade 46, cutting blade 46 applies a shearing and cutting effect to slice the debris into smaller pieces. At the same time, the cutting blade 46 imparts a swirling motion to the cut pieces, which move radially outwards towards the sharp edges of housing cutting profile 44, where the debris size is reduced further by a shearing and tearing action.

Fluid F with the even smaller-sized debris then migrate to the first set of the series of mill cutter profiles 52 in the funnel-like annular mill space 58. These first set of cutters, which are in the annular mill space 58, impart a cutting effect on the debris and progressively move the debris downstream. Furthermore, the swirling motion of the series of mill cutter profiles 52 push the debris towards housing cutting profile 44, where additional shearing occurs. As the debris progressively moves to subsequently narrow regions of the funnel-like annular mill space 58, the debris comes into regions of smaller area in the funnel-like annular section, where they experience additional cutting, shearing and tearing, which reduces the size of the debris even further.

The mixture of fluid F and debris leaves the funnel-like annular mill space 58 and passes by mill grinding profile 60, where the debris size is pulverized enough to pass through the remaining sections of electrical submersible pump assembly 14, including pump 18. The pulverized debris blends thoroughly with the well fluid F. Well fluid F with pulverized debris then exits mill grinding profile 60 and moves towards handler housing outlet 62, which is appropriately spaced axially from the mill grinding profile 60 to ensure fluid F is swirl-free before exiting debris handling assembly 32 and entering into another component of electrical submersible pump assembly 14. Swirl-free flow is important, for instance, upstream of the first impeller in pump 18 to develop a higher total dynamic head.

In embodiments described herein, if large debris material, such as large rubber pieces pass through the intake holes 42, cutting blade 46 is sized and oriented to handle such large pieces and reduce the size of the debris so that mill 50 is able to accommodate all debris that passes by cutting blade 46 without being blocked up. In addition, the funnel-like shape of annular mill space 58 allows for mill 50 to accept relatively larger debris at an upstream end and progressively reduce the size of the debris without becoming blocked.

When the debris exits debris handling assembly 32, the debris is sufficiently small that it can pass through the vanes of pump 18 without causing blockage or damaging pump 18. Pump 18 pressurizes the mixture, which flows through the production tubing to the surface, in a conventional process. At the surface, fluid F can be treated to separate the well fluids from any small debris in a manner similar to current procedure in conventional systems.

Because the size of the pulverized debris is sufficiently small, the intake of pump 18 may not have an intake screen as it is not required since the blended mixture of fluid F that contains debris does not contain particles that can clog the intake ports. The absence of the screen saves both material and labor costs. Another advantage of not having an intake screen on pump 18 is eliminating pressure drop experienced as fluid F goes through pump intakes, thereby improving system efficiency. If an operator decides to still have an intake with a screen, the screen serves as a redundant component. The absence of intake screens from the pump is applicable as an option in two-packer configurations such as shown in FIG. 2, where the debris handler is upstream of the pump.

Therefore, as disclosed herein, embodiments of the systems and methods provide ESP solutions with little to no risk for intake screen collapse. Potential for pump clogging is eliminated, thereby increasing the ESP life and preventing motor high temperature due to no flow or overload failure that would have incurred workover costs. In addition, there is a reduction in pressure losses and an improvement in system efficiency compared to equipment with axially changing flow directions, such as introducing flow reversals into the system. Furthermore, the damage due to having large, hard and sharp-edged debris flowing past the motor and protector has been reduced in certain embodiments where debris handling assembly 32 is upstream of such elements. As a result, overall ESP system reliability is increased and asset life operating costs are reduced.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. An electrical submersible pump assembly for producing hydrocarbons from a subterranean well, the electrical submersible pump assembly comprising:

a motor, a pump, and a seal section located between the motor and the pump;

a debris handling assembly located upstream of the pump, the debris handling assembly including:

a handler housing, the handler housing being a generally tubular member with an inner bore;

a housing cutting profile located on an inner surface of the inner bore of the handler housing;

a cutting blade secured to a rotating shaft within the inner bore of the handler housing, the cutting blade being aligned with a first portion of the housing cutting profile;

a mill secured to the rotating shaft within the inner bore of the handler housing, the mill aligned with a second portion of the housing cutting profile; and an annular mill space, the annular mill space defined by an outer surface of the mill and the inner surface of the inner bore, the annular mill space decreasing in a radial dimension in a downstream direction.

2. The electrical submersible pump assembly of claim 1, wherein the mill has a series of mill cutter profiles located on the outer surface of the mill.

3. The electrical submersible pump assembly of claim 2, wherein the series of mill cutter profiles includes longer teeth with a longer radial dimension at an upstream region of the outer surface and further includes shorter teeth with a shorter radial dimension at a downstream region of the outer surface.

4. The electrical submersible pump assembly of claim 2, wherein the series of mill cutter profiles are formed of a hard material selected from a group consisting of polycrystalline diamond compact, silicon carbide, tungsten carbide, and boron nitride.

5. The electrical submersible pump assembly of claim 2, wherein the mill has a mill grinding profile located on the outer surface of the mill downstream of the series of mill cutter profiles.

6. The electrical submersible pump assembly claim 1, wherein the cutting blade and the mill are spaced axially apart along the rotating shaft.

7. The electrical submersible pump assembly of claim 1, wherein the handler housing includes intake holes, the intake holes being free of a screen member.

8. The electrical submersible pump assembly of claim 1, wherein a handler housing outlet is axially spaced apart from a downstream end of the mill.

9. The electrical submersible pump assembly of claim 1, wherein the debris handling assembly has a radially oriented intake and an axially oriented discharge.

10. The electrical submersible pump assembly of claim 1, wherein the debris handling assembly has an axially oriented intake and a radially oriented discharge.

11. The electrical submersible pump assembly of claim 1, wherein the debris handling assembly is located upstream of the motor.

12. The electrical submersible pump assembly of claim 1, further including a lower packer positioned to prevent wellbore fluids from traveling downstream past the electrical submersible pump assembly external of the debris handling assembly.

13. The electrical submersible pump assembly of claim 1, wherein the handler housing is rotationally static within the subterranean well.

14. The electrical submersible pump assembly of claim 1, wherein the outer surface of the mill has a frustoconical shape.

15. A method for decreasing a size of debris entering an electrical submersible pump assembly in a subterranean well with a debris handling assembly, the method including:

providing a handler housing, the handler housing being a generally tubular member with an inner bore and having a housing cutting profile located on an inner surface of the inner bore of the handler housing;

rotating a shaft within the inner bore of the handler housing to rotate a cutting blade secured to a rotating shaft, and to rotate a mill secured to the rotating shaft;

directing an output stream of the debris handling assembly towards a pump of the electrical submersible pump assembly; wherein the cutting blade is aligned with a first portion of the housing cutting profile and the mill is aligned with a second portion of the housing cutting profile; and wherein an annular mill space is defined by an outer surface of the mill and the inner surface of the inner bore, the annular mill space decreasing in a radial dimension in a downstream direction.

16. The method of claim 15, wherein the mill has a series of mill cutter profiles located on the outer surface of the mill that includes longer teeth with a longer radial dimension at an upstream region of the outer surface and further includes shorter teeth with a shorter radial dimension at a downstream region of the outer surface, the method further comprising progressively decreasing a size of the debris with the housing cutting profile and the series of mill cutter profiles as the debris moves axially along the mill.

17. The method of claim 15, further including grinding the debris with a mill grinding profile of the mill, the mill grinding profile being located downstream of mill cutter profiles.

18. The method of claim 15, further comprising moving the debris radially outward with rotational movement of the cutting blade and the mill so that the debris contacts the housing cutting profile.

19. The method of claim 15 further including directing an input stream into the debris handling assembly upstream of a pump and motor of the electrical submersible pump assembly.

* * * * *